United States Patent [19]

Kaimo

[11] Patent Number: 4,865,503

[45] Date of Patent: Sep. 12, 1989

[54] DEVICE FOR JOINING TOGETHER BUILDING UNITS

[75] Inventor: Matti O. Kaimo, Virkkala, Finland

[73] Assignee: Oy Lohja AB, Nummela, Finland

[21] Appl. No.: 111,274

[22] Filed: Oct. 22, 1987

[30] Foreign Application Priority Data

Oct. 27, 1986 [FI] Finland ..... 864337

[51] Int. Cl.[4] ..... F16B 19/00; F16C 11/06

[52] U.S. Cl. ..... 411/361; 411/513; 403/155; 403/326

[58] Field of Search ..... 411/320, 363–365, 411/360–362, 353, 447, 513, 515, 517, 541, 540; 403/155, 324, 326, 371, 377; 29/438–440, 509, 515

[56] References Cited

U.S. PATENT DOCUMENTS

| | | | |
|---|---|---|---|
| 1,395,526 | 11/1921 | Schafer | 411/361 |
| 1,873,245 | 8/1932 | Abegg | 403/377 |
| 2,219,591 | 10/1940 | Hiester | 29/439 |
| 2,558,704 | 6/1951 | Heimann et al. | 411/517 |
| 3,884,589 | 5/1975 | Liedholm | 411/353 |

FOREIGN PATENT DOCUMENTS

| | | | |
|---|---|---|---|
| 392137 | 3/1924 | Fed. Rep. of Germany | 411/522 |
| 838670 | 5/1952 | Fed. Rep. of Germany | 411/522 |
| 57293 | 3/1980 | Finland . | |
| 58669 | 11/1980 | Finland . | |

*Primary Examiner*—Neill R. Wilson

*Attorney, Agent, or Firm*—Finnegan, Henderson, Farabow, Garrett & Dunner

[57] ABSTRACT

The present invention relates to a device for joining together building units, comprising a lock housing (2) positioned in one building unit; a peg (3) projecting from the other building unit; and a locking means (7) by means of which the peg is locked in the lock housing and which comprises two branches (10, 11). After having passed the peg, the branches are turned towards each other by means of a guide surface (12) provided in the lock housing (2). In prior devices the locking means (7) has to be very strong because the contact surface between it and the flange of the peg is small. A large contact surface can be provided between the locking means and the flange of the peg by forming the guide surface into a continuous arched surface (12) which bends the branches sharply towards each other.

5 Claims, 3 Drawing Sheets

Figure 2:
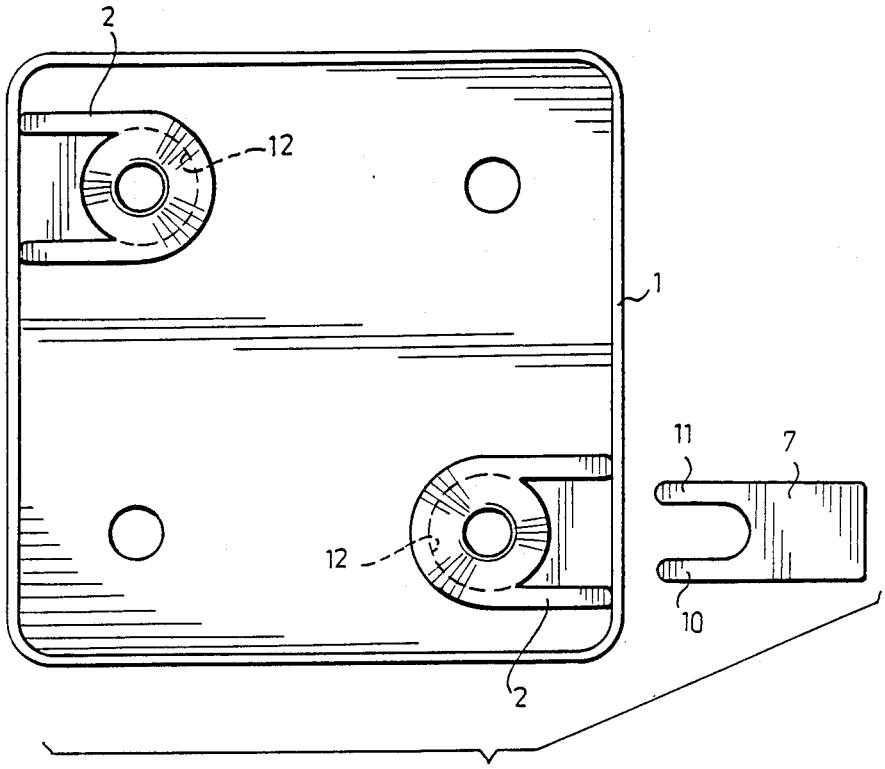
Figure 4:
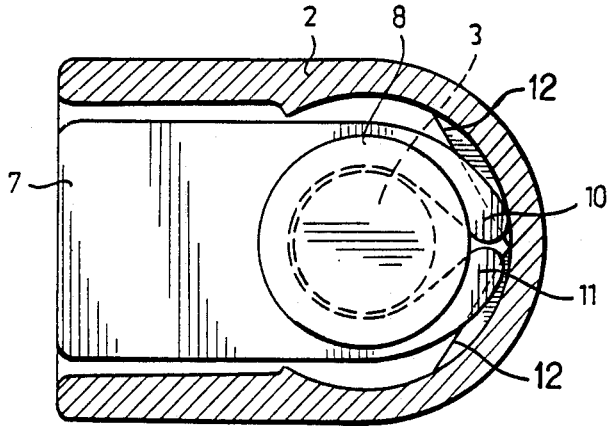

FIG. 1
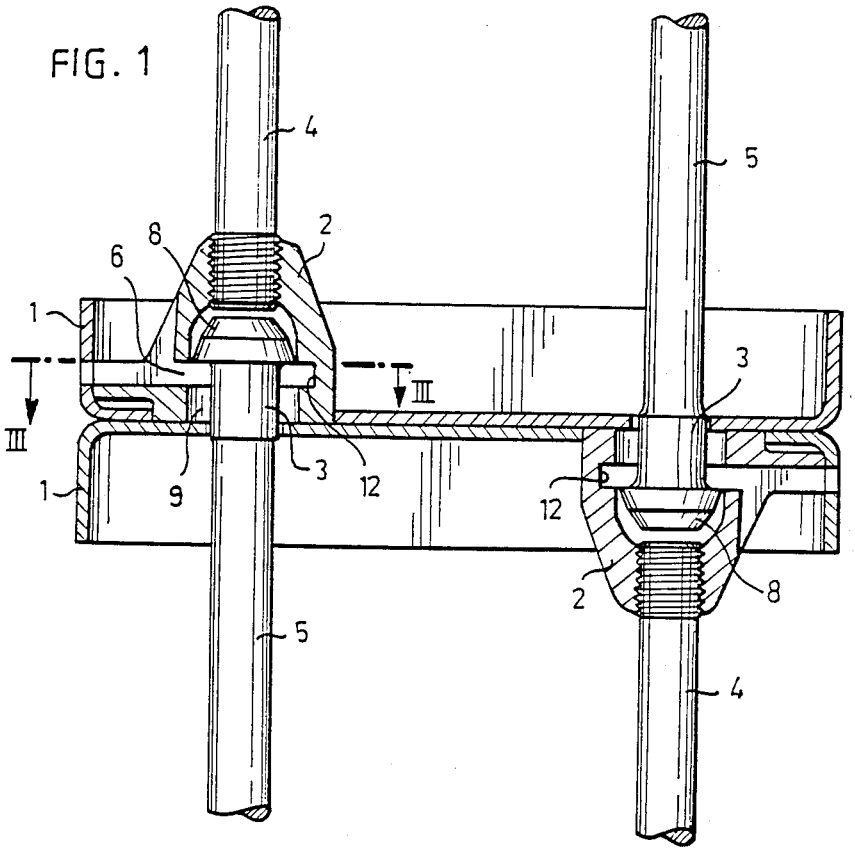
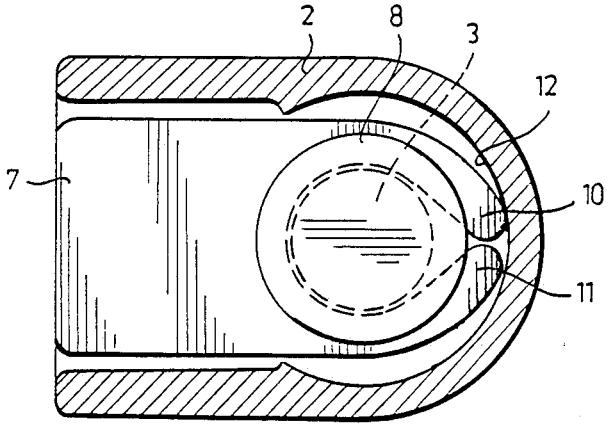
FIG. 3

DEVICE FOR JOINING TOGETHER BUILDING UNITS

The present invention relates to a device for joining together building units, comprising a lock housing positioned in one building unit; a peg projecting from the other building unit and arranged to be inserted into the lock housing in the joined position of the units, the free end of said peg being provided with a flange; and a locking means which is arranged to be inserted into the lock housing for locking the peg in the housing in the direction of the longitudinal axis thereof and comprises two branches arranged to be positioned on different sides of the peg, the lock housing being provided with a guide surface for turning the branches towards each other after they have passed the peg.

A device of the kind described above is disclosed in Finnish Patent Specifications Nos. 57 293 and 58 669. In the latter patent specification, the lock housing is trough-shaped and the guide surface for the branches of the locking means is formed by providing the side walls of the trough with transverse cuttings at which wall portions bent obliquely inwards are provided. The wall portions cause the branches of the locking means to be bent towards each other after having passed the peg. In order that the locking means would not come off e.g. due to shocks exerted on a concrete pile, the outer surface of the branches is provided with a recess positioned at the backward edge of the wall portions when the locking means is in place.

This kind of device is easy to manufacture, wherefore it has become very popular. However, it has the drawback that the contact surface between the flange of the peg and the locking means is relatively small, which is due to the fact that the branches are bent to a relatively small degree, see Finnish Patent Specification No. 58 669, FIG. 1. A relatively small portion of the locking means thus has to receive all strains exerted in the direction of the peg, wherefore the locking means has to be strong.

The object of the present invention is to provide a device in which the locking means need not be as strong as previously. A device according to the invention is characterized in that the guide surface of the lock housing is oblique and is positioned behind the peg as viewed in the direction in which the locking means is knocked in place.

By forming the guide surface into an oblique surface positioned behind the peg, an advantage is achieved in that the branches of the locking means turn behind the peg more sharply than previously, so that the contact surface between the locking means and the flange is increased. Since the strain exerted on the locking means is thereby distributed over a larger surface, the locking means can be thinner than previously. The sharp turning of the branches behind the peg further ensures that the locking means stays in place when the joint is exposed to shocks, by virtue of which there is no need for recesses on the outer surface of the branches.

According to a preferred embodiment of the invention the guide surface is a substantially continuous arched surface. A surface of this kind is easy to manufacture.

It is most simple in view of the manufacture if the guide surface has the shape of a part of a circumference. For the same reason, it may thereby also be concentric with the peg.

In the following a preferred embodiment of a device according to the invention will be described in more detail with reference to the attached drawings, wherein FIG. 1 is a vertical section of the device, FIG. 2 is a top view of the device, and FIG. 3 is a horizontal sectional view along the line III...III shown in FIG. 1.

FIG. 1 shows an extension joint between two concrete piles by way of example. Metal plates 1 bent into the shape of a shallow bowl are provided at the ends of the piles, and e.g. two lock housings 2 and two pegs 3 are fastened in these plates. The lock housings and the pegs are so positioned at the ends of the piles that when the piles are positioned one after the other, the pegs are inserted into the lock housings as shown in FIG. 1. Concrete steels 4 are fastened in the lock housings 2, and the pegs 3 are formed by concrete steels 5 projecting outside the metal plate.

An opening 6 is provided in the side wall of the lock housings, through which opening a two-branch locking means 7 can be knocked into the lock housing so that the branches surround the peg 3.

The free end of the peg is provided with a ring flange 8 preferably integral with the peg 3 and formed by jolting the end of the concrete steel 5. The function of the flange 8 is to lock the peg in the longitudinal direction thereof in the lock housing by means of the locking means 7. In order that the peg could be inserted into the lock housing 2, an inlet 9 of the lock housing has a diameter at least equal to the diameter of the flange 8.

The branches of the locking means 7 are indicated with the reference numerals 10 and 11. In order to turn the branches towards each other, a guide surface 12 is provided in the lock housing.

According to the preferred embodiment of the invention the guide surface of the lock housing is a substantially continuous arched surface positioned behind the peg 3 as viewed in the direction in which the locking means 7 is knocked in place. In the embodiment described, the guide surface 12 has the shape of a part of a circumference and it is concentric with the peg 3 and the inlet 9 of the lock housing. The angle length of the surface acting as a proper guide surface is 90° to 180°.

The concrete piles are joined together by placing them one upon the other as shown in FIG. 1, so that the pegs 3 are inserted into the lock housings 2, and by knocking the locking means 7 from the side in place into the lock housings through the opening 6. Due to the arched continuous guide surface 12, the branches 10, 11 of the locking means are turned sharply towards each other until they meet each other as shown in FIG. 3. It appears from FIG. 3 that a major part of the surface of the flange 8 makes contact with the locking means 7 and that not even hard shocks can cause the locking means to be removed from the lock housing.

According to another embodiment of the invention, the guide surface comprises at least two straight surfaces defining an angle with respect to each other and the direction in which the locking means 7 is knocked in place. In FIG. 3, two surfaces defining an angle with respect to each other are indicated by means of broken lines.

The use of the device according to the invention is not restricted to the joining of concrete piles; it can as well be used for joining together any building units.

I claim:

1. A device for joining together building units, comprising a lock housing positioned in a first building unit, the lock housing having a side wall provided with an opening therein; a peg projecting from a second building unit and arranged to be inserted into the lock housing in the joined position of the units; the free end of said peg being provided with a flange; and a locking means arranged to be inserted into the opening in the lock housing and knocked in place for locking the peg in the housing in the direction of the longitudinal axis thereof and which comprises two branches arranged to be positioned on different sides of the peg in the lock housing; wherein the lock housing is provided with a guide surface for turning the branches towards each other after they have passed the peg, and the guide surface of the lock housing is a substantially continuous arched surface positioned behind the peg as viewed in the direction in which the locking means is knocked in place.

2. A device according to claim 1, wherein the guide surface has the shape of a part of a circumference.

3. A device according to claim 1, wherein the guide surface is concentric with the peg.

4. A device according to claim 1, wherein the angle length of the guide surface is from 90° to 180°.

5. A device for joining together building units, comprising a lock housing positioned in a first building unit, the lock housing having a side wall provided with an opening therein; a peg projecting from a second building unit and arranged to be inserted into the lock housing in the joined position of the units, the free end of said peg being provided with a flange; and a locking means arranged to be inserted into the opening in the lock housing and knocked in place for locking the peg in the housing in the direction of the longitudinal axis thereof and which comprises two branches arranged to be positioned on different sides of the peg in the lock housing; wherein the lock housing is provided with a guide surface for turning the branches towards each other after they have passed the peg, and the guide surface of the lock housing comprises at least two straight surfaces defining an angle with respect to each other and the direction in which the locking means is knocked in place and is positioned behind the peg as viewed in the direction in which the locking means is knocked in place.

* * * * *